US005192234A

United States Patent [19]

Heng et al.

[11] Patent Number: 5,192,234

[45] Date of Patent: Mar. 9, 1993

[54] ELECTRICAL TERMINAL AND A HOUSING FOR ELECTRICAL APPARATUS INCLUDING SUCH A TERMINAL

[75] Inventors: Jean-Paul Heng, Lyon; André Marmonier, Bron, both of, France

[73] Assignee: Entrelec S.A., Villeurbanne, France

[21] Appl. No.: 873,226

[22] Filed: Apr. 24, 1992

[30] Foreign Application Priority Data

Apr. 26, 1991 [FR] France ..... 91 05191

[51] Int. Cl.[5] ..... H01R 4/38

[52] U.S. Cl. ..... 439/806; 439/709

[58] Field of Search ..... 439/709, 806, 812-814

[56] References Cited

U.S. PATENT DOCUMENTS 4,006,323 2/1977 Nelson et al. .

4,810,212 3/1989 Norden .

FOREIGN PATENT DOCUMENTS 1903220 10/1970 Fed. Rep. of Germany .

8534698 2/1986 Fed. Rep. of Germany .

1363909 5/1964 France ..... 439/806

*Primary Examiner*—Eugene F. Desmond

*Attorney, Agent, or Firm*—Sughrue, Mion, Zinn, Macpeak & Seas

[57] ABSTRACT

A terminal for electrical equipement in which a wire is held in a wire-insertion duct between a clamping element of a strip and another clamping element constituting the bottom of a cage that surrounds the strips. The wire is held by drive from a screw with the screw being screwed into the cage and pressing obliquely against the clamping element of the strip on the opposite side thereof to its side which faces the clamping element of the cage. The clamping element of the cage is extended by an extension constituting a wire-guide which projects from the cage into the wire insertion duct parallel to the screw axis and which obstructs the duct to guide any wire disposed obliquely in the wire-insertion duct.

9 Claims, 3 Drawing Sheets

ELECTRICAL TERMINAL AND A HOUSING FOR ELECTRICAL APPARATUS INCLUDING SUCH A TERMINAL

The invention relates to electrical terminals, of the screw type for axial connection, and to electrical equipment housings including at least one such terminal.

BACKGROUND OF THE INVENTION

French patent No. 2 574 598 describes an electrical terminal, in particular a miniature terminal, in which an electrically conductive wire is held against a wire-clamping wall of a conductive strip of electrical equipment, such as a junction block, for example, between said clamping wall and an internal wire-clamping wall of a cage that surrounds the strip, the wire being held under drive from a clamping screw which is screwed into the cage and which bears against the side of the strip opposite to the two wire-clamping walls.

The clamping screw is disposed obliquely in the cage relative to the wire-clamping wall of said cage and its tip presses directly against the strip. The screw is also pressed laterally against a lateral clamping element provided for this purpose on the cage.

A conductor wire is thus inserted between the clamping walls provided therefor on the strip and in the cage of a terminal along a direction that is oblique relative to the axis of the clamping screw.

When the terminal is housed in a box, e.g. of a connector, of a junction block, or of any other electrical equipment, the box generally includes an opening via which the wire is inserted into the terminal and a separate opening giving access to the clamping screw.

The terminal mentioned above is designed more specifically for equipment having a box in which the wire insertion opening and the screw-access opening for the same terminal are oriented obliquely relative to each other, each opening lying in a different face of the box, for example.

In contrast, it does not lend itself easily to making boxes for which axial connection is possible, i.e. for which the wire insertion opening and the screw-access opening of the same terminal lie parallel, which makes it possible, in particular, for them to open out in parallel in the same face of the box. However, this feature may be important since under some operating conditions, access can be obtained to a box via one of its faces only, in particular via a "front" face.

SUMMARY OF THE INVENTION

The invention thus provides an electrical terminal derived from that disclosed in the above-mentioned French patent, for putting a conductor wire into connection with a conducting strip of electrical equipment by holding the wire against a clamping element of the strip between said element and another clamping element which constitutes the at least approximately parallel bottom of a cage which surrounds the strip, clamping being obtained under drive from a clamping screw screwed into an element of the cage and situated opposite to the element constituting the bottom, the end of the screw pressing against the face of the clamping element of the strip which faces away from the clamping element of the cage, said screw being disposed obliquely relative to said clamping elements of the strip and of the cage, and pressing against at least one lateral thrust structure opposing the transverse repulsion reaction of the end of the screw on the clamping strip in the cage, the clamping elements of the strip and of the cage delimiting between them an insertion duct for the wire, which duct extends obliquely relative to the screw.

According to a characteristic of the invention, the clamping element of the cage is extended by an extension constituting a wire-guide which projects beyond the cage from one of the sides into which the wire insertion duct opens out.

The invention also provides an electrical equipment box in a body of insulating material within which the cage, the screw, and the strip are housed, the strip being held stationary therein while the cage is capable of guided displacement therein along the screw axis under drive from the screw, between two positions corresponding respectively to the wire clamping elements of the strip and of the bottom of the cage being at a minimum separation and to said elements being at a maximum separation.

According to a characteristic of the invention, the box includes an arrangement for preventing the screw moving in translation, enabling said screw to be rotated via its head through an access opening of the box next to which there opens out a wire insertion duct extending at least approximately parallel to the cage displacement direction defined by the screw axis, said insertion duct being closed by an extension of the cage in question which penetrates obliquely into the duct to constitute an end wall extending to the vicinity of a wall of said duct with which it provides relative continuity for guidance of a wire within the insertion duct of the cage when the wire is pushed along said insertion duct from the opening thereof.

BRIEF DESCRIPTION OF THE DRAWINGS

An embodiment of the invention is described by way of example with reference to the accompanying drawings, in which.

DETAILED DESCRIPTION

Figure 1:
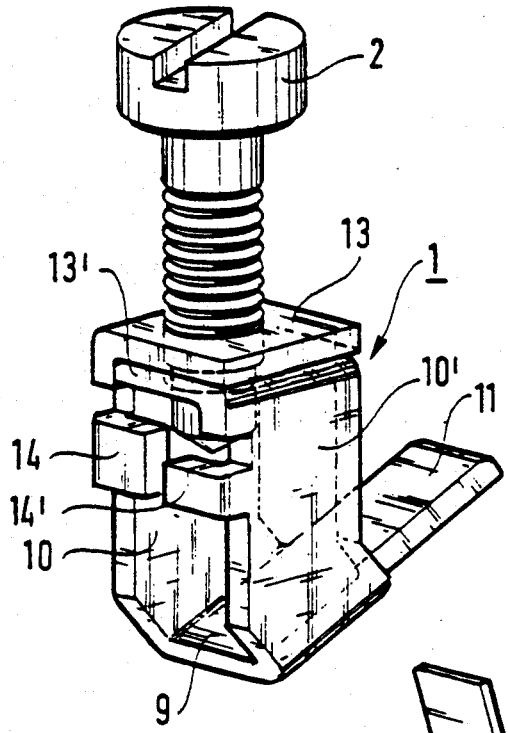
FIG. 1 shows an example of a screw cage for a terminal of the invention.
Figure 3:
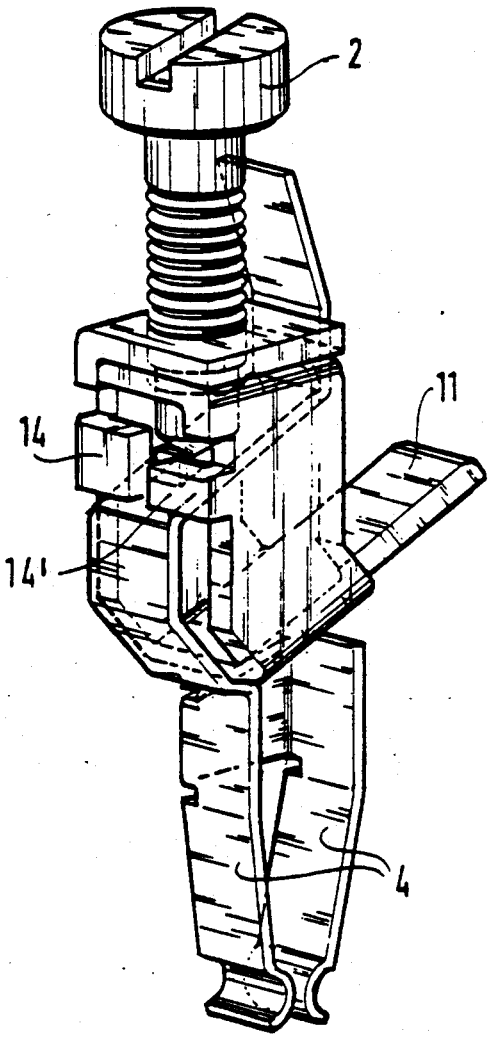
FIG. 3 shows a terminal made up of the screw cage and of the strip as shown in FIGS. 1 and 2.
Figure 2:
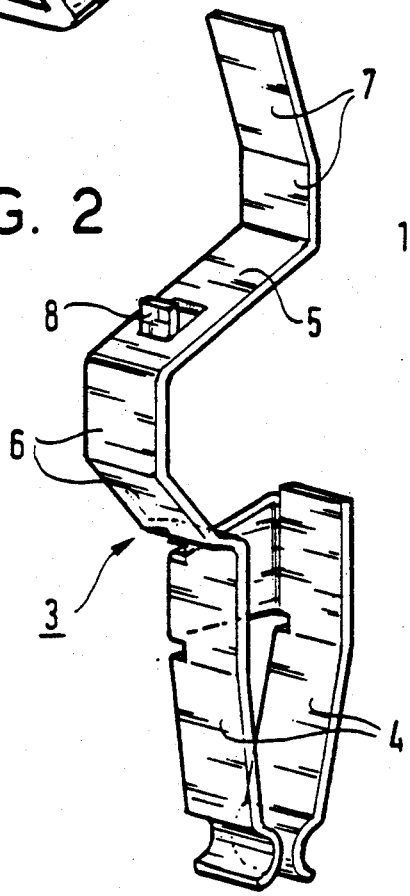
FIG. 2 shows one example of a strip for a terminal of the invention.

The electrical terminal whose essential component parts are shown in FIGS. 1 to 3 comprises a cage 1 provided with a clamping screw 2 as shown in FIG. 1, and a conducting strip 3, one embodiment thereof being shown in FIG. 2.

The cage 1 and the strip 3 are designed to co-operate with each other firstly to hold an end of a conductor wire between them and secondly to put said conductor wire into electrical connection with electrical equipment via a connector member 4 that may be carried by the strip as shown in FIGS. 2 to 5, or possibly by the cage, said connector member 4 being of the spring blade type, for example, as shown herein.

The cage 1 and the assembly constituted by the strip 3 and by the connector member 4 are assumed in this case to be made by cutting and folding metal blanks using techniques well known in this field, even though such a cage may also be obtained by other techniques, e.g. by molding.

The strip 3 per se is assumed in this case to be constituted by a strip of resilient electrically-conductive metal of generally rectangular appearance extending a common portion that unites the two spring blade jaws that constitute the connector member 4 in this case. The generally rectangular strip portion includes a clamp element 5 having one wall which is pressed against the conductor wire to be connected.

The clamp element 5 is connected in this case to the common portion uniting the jaws by means of a wire-stopping stop element 6 against which the end of a conductor wire to be connected normally comes into abutment.

The stop element 6 is constituted in this case by two successive portions which extend obliquely relative to each other and relative to the elements from which they extend via respective folds, i.e. one of them extends obliquely relative to the clamp element 5 while the other extends obliquely relative to the connector member 4.

The end of the clamp element 5 distant from the stop element also continues in the form of a wire-guide element 7 likewise assumed to be made up of two successive portions that extend obliquely by transverse folding relative to each other and relative to the clamp element that is extended by one of them.

A projection 8 is provided to serve as an end stop for the screw 2 against the clamp element 5.

In this case, the projection 8 is in the form of a tongue partially cut out from the metal forming the strip before folding.

The cage 1 is intended to surround the strip 3 over the clamp element 5.

The cage 1 is made by folding around a central element 9 which is intended to serve as an internal clamp at the bottom of the cage for the wire to be connected.

The clamp element 9 is designed to slope obliquely relative to the remainder of the cage and at least approximately parallel to the clamp element 5 of the strip 3 once the terminal that includes them has been assembled, thereby co-operating with said clamp element 5 to delimit a wire-insertion duct and optionally to be pressed thereagainst by drive from the screw 2.

Two parallel sides of the clamp element 9 are identically extended by two strip elements 10 and 10' that are folded to extend perpendicular thereto and parallel to each other when the cage is completed.

The clamp element 9 is also extended by a wire-guide extension 11 that projects out from the cage, in this case in the same plane as the element 9 itself, but optionally at a slightly different angle.

The two strip elements 10 and 10' are interconnected by at least one (and in this case two) elements 13 and 13' each of which is folded perpendicularly relative to the strip 10 or 10' from which it projects to extend towards the other element to co-operate therewith to constitute a single link element of double thickness through which a tapped bore is formed for receiving the screw 2.

The screw penetrates into the cage via said tapped bore to bear against the projection 8 on the strip 3, and it also bears against a clamping structure constituted by two projections 14 and 14' extending laterally from respective ones of the strip elements 10 and 10' in a direction perpendicular thereto so as to serve as a lateral abutment for the screw 2 whose shank is preferably smooth at this point, or else (as shown herein) is given a conical thrust tip for pressing against the strip 3.

The strip 3 is engaged inside the cage 1 in such a manner as to cause the clamp element 5 to extend parallel to the clamp element 9 between the clamp elements 10 and 10', and co-operating with the clamp element 9 to define the wire-insertion duct.

The guide element 7 takes up a position along the screw 2 at its side adjacent to the end of the wire-insertion duct where the wire-guide extension 11 is located, with the wire stop element 6 being at the opposite end of the wire-insertion duct which it closes in the vicinity of the projections 14 and 14'.

Figure 4:
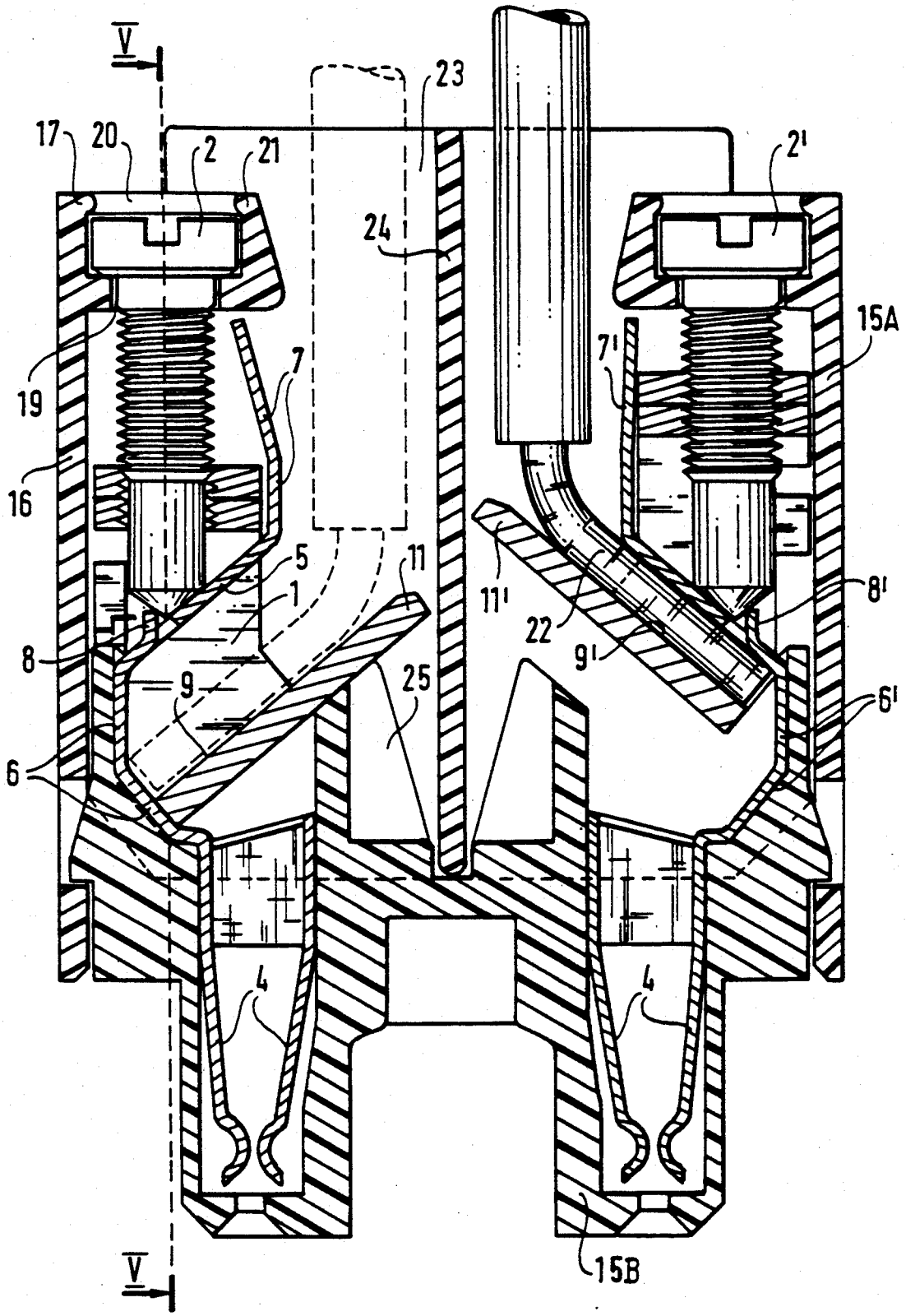
FIG. 4 is a section on IV—IV through an equipment box including terminals as described with reference to the preceding figures.
Figure 5:
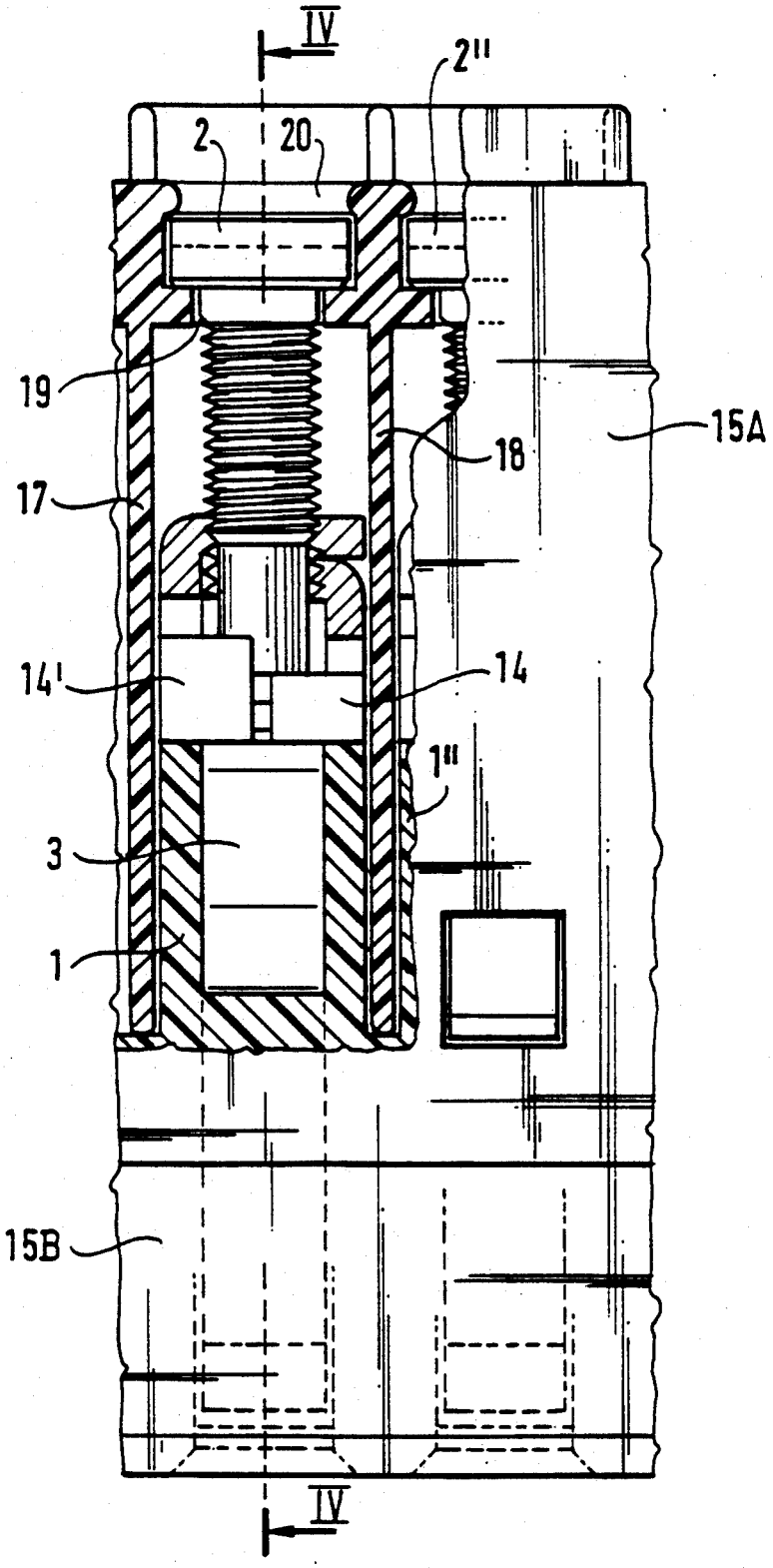
FIG. 5 is a fragmentary section on V—V through a portion of the box shown in FIG. 4.

One example of how an electrical terminal of the invention can be used in electrical equipment is shown in FIGS. 4 and 5 which relate to a connector comprising two rows of such terminals in a box of insulating material constituted in this case by two interfitting portions 15A and 15B. Each of the terminals shown in FIG. 4 comprises a cage 1 or 1', a screw 2 or 2', and a strip 3 or 3' received in the box 15A, 15B in such a manner that the screws 2 and 2' are parallel and lie along respective edges of the box.

The same applies for the terminal constituted by the cage 1", the screw 2", and the strip 3" which can be seen in FIG. 5 together with the cage 1, the screw 2, and the strip 3.

Each strip is individually held in the box, e.g. after the portion 15A has been engaged on the portion 15B, by complementary shapes of said strips and of housings in the box in which they are positioned, as is conventional in this field.

Each cage surrounds the corresponding strip as mentioned above and is capable of moving relative thereto in translation along the axis of the corresponding clamping screw and within a rectilinear guide formed in the example shown by the outside wall of the box (such as 16 in FIG. 4) running parallel to the associated screw (2 in this case), and by parallel guide walls (such as 17 and 18 in FIG. 5) which are perpendicular to said outside wall of the box and which separate the terminals from one another.

Each screw is held stationary in translation firstly because of its tip pressing against the projection provided for this purpose on the clamp element of the corresponding strip such as the projection 8 on the clamp element 5 for the screw 2, and secondly because of the head of the screw being held partially captive in an arrangement such as 17 for the screw 2 and integrally molded in this case in portion 15A of the box.

In this case said arrangement comprises an individual housing for each screw head which is preferably designed to be cylindrical, each housing opening firstly via a duct such as 19 for passing the shank of the screw towards the rectilinear guide in which the cage associated with the screw is displaced, and secondly via an access opening such as 20 provided in an outside wall of the box, and in this case in the portion 15A thereof, enabling the screw initially to be inserted and subsequently to be rotated from outside the box.

The screw head is held captive in the housing of an arrangement 17 for example by means of a peripheral rim such as 21 formed around the opening 20. A screw such as 2 can be rotated alternately to move the clamping walls 5 and 9 of the strip and of the cage associated with said screw away from each other and towards each other between a minimum separation position and a maximum separation position.

FIG. 4 shows the screw 2 in the maximum separation position which enables a conductor wire as shown by dashed lines to be inserted, and when connected, a conductor wire 22 is clamped as shown with reference to the screw 2' in said FIG. 4.

A wire to be connected is inserted into a terminal in the box 15A, 15B via an insertion duct such as 23 (FIG. 4), which duct opens out close to the access opening 20 of the screw of said terminal, said insertion duct being parallel in this case to the direction in which the cage of the terminal moves.

Each insertion duct 23 is bounded on two sides, for example, by parallel walls such as the walls 17 and 18 between which the associated cage moves, and on a third side by a wall 24 integral with one of the component portions of the box, and in this case the portion 15A.

In the example shown, this wall is common to two parallel terminals disposed side by side in the box, and a fourth wall of the insertion duct is formed in this case by an element of the strip such as the element 7 which projects beyond the wire-insertion duct formed between the clamping walls 5 and 9 of the strip and of the cage and presses against the screw and the portion of the cage in which the screw is received.

In a preferred embodiment, the element 7 slopes obliquely towards the shank of the screw and towards the head of the screw, and it pushes back the cage against which it presses against the wall 16 of the box so that the cage slides along said wall towards the clamping element 5 of the strip when the distance between the clamping elements 5 and 9 of the strip and of the cage is other than their maximum separation distance for prepositioning the cage in the housing before a wire is connected thereto.

The insertion duct associated with a terminal communicates with the insertion duct provided for the terminal and it is closed by the extension 11 on the corresponding clamping wall 9 of the cage.

Inserting a wire from outside the box into an insertion duct such as 23 brings the end of the wire against the extension 11 situated at the end of the duct, in this case pressing against an abutment such as 25 when the cage is at the bottom of its housing and the clamping walls are in their maximum separation position.

While the conductor is being pushed, the slope of the extension 11 directs the end of the conductor towards the inside of the insertion duct until it comes into abutment against the wire stop element such as 6 which terminates the insertion duct.

Tightening the screw raises the cage whose clamping wall moves towards the clamping wall of the associated strip, thereby clamping on the wire, as can be seen in the righthand portion of FIG. 4.

We claim:

1. An electrical terminal for putting a conductor wire into connection with a conducting strip of electrical equipment by holding the wire against a clamping element of the strip between said element and another clamping element which constitutes the at least approximately parallel bottom of a cage which surrounds the strip, clamping being obtained under drive from a clamping screw screwed into an element of the cage and situated opposite to the bottom, the end of the screw pressing against the face of the clamping element of the strip which faces away from the clamping element of the cage, said screw being disposed obliquely relative to the clamping elements of the strip and of the cage, and pressing against at least one lateral thrust structure opposing the transverse repulsion reaction of the end of the screw on the clamping elements on the strip on clamping, the clamping elements of the strip and of the cage delimiting between them an insertion duct for the wire, which duct extends obliquely relative to the screw, wherein the clamping element of the cage is extended by an extension constituting a wire-guide which projects beyond the cage from one of the sides into which the wire insertion duct opens out.

2. An electrical terminal according to claim 1, wherein the wire-guide extension is situated at the end of the insertion duct which is on the side opposite to the side where the structure for pressing the screw laterally against the cage is to be found.

3. An electrical terminal according to claim 1, wherein the cage is made from a strip of cutout and folded sheet metal to form two parallel elements each connected firstly at one end to a common central clamping element disposed obliquely and serving to clamp against the wire, and secondly at its opposite end by at least one link element extending perpendicularly thereto and including a tapped bore for positioning the clamping screw parallel to said parallel elements so as to press against a lateral thrust structure for the screw constituted by two projections carried laterally by respective ones of the parallel elements, and includes a clamping element which, extending obliquely, is provided with an extension extending beyond the parallel element to one side of the cage where the wire-insertion duct opens out to form a wire-guide.

4. An electrical terminal according to claim 1, wherein the clamping element of the strip extends in the form of an element which is disposed to project beyond the cage in a direction at least approximately parallel to the axis of the clamping screw through the opening of the wire-insertion duct on the same side of the cage as the wire-guide extension and on the other side of the duct opening from said wire-guide extension.

5. An electrical terminal according to claim 1, wherein the clamping element of the strip is extended by a second element which closes the wire-insertion duct of the cage on the other side of said duct in the cage relative to the wire-guide extension and optionally relative to the first extension of the strip.

6. An electrical equipment box including internally at least one terminal according to claim 1 in a body of insulating material within which the cage, the screw, and the strip are housed, the strip being held stationary therein while the cage is capable of guided displacement therein along the screw axis under drive from the screw, between two positions corresponding respectively to the wire-clamping elements of the strip and of the bottom of the cage being at a minimum separation and to said elements being at a maximum separation, the box further including an arrangement for preventing the screw moving in translation, enabling said screw to be rotated via its head through an access opening of the box next to which there opens out a wire insertion duct extending at least approximately parallel to the cage displacement direction defined by the screw axis, said insertion duct being closed by an extension of the cage in question which penetrates obliquely into the duct to constitute an end wall extending to the vicinity of a wall of said duct with which it provides relative continuity for guidance of a wire within the insertion duct of the cage when the wire is pushed along said insertion duct from the opening thereof.

7. An electrical equipment box according to claim 6, wherein the arrangement for retaining the clamping screw in translation comprises an element for partially holding captive the head of the screw and co-operating with the thrust projection of the strip on which the screw presses, said element being constituted by a portion of the box which includes a housing for holding captive a cylindrical screw head, said housing opening out firstly into a duct for passing the shank of the screw and in the opposite direction opening out into an access opening enabling the head of the screw to be rotated.

8. An electrical equipment box according to claim 6, including an abutment element for the wire-guide extension against which said wire bears when the clamping elements of the strip and of the cage are in their maximum separation position.

9. An electrical equipment box according to claim 6, wherein the wire insertion duct of a terminal is at least partially delimited by an element included in the strip of said terminal adjacent to said duct and close to the clamping screw, said first element being folded back obliquely towards the shank of the screw and towards the head of said screw, bearing against the cage of the screw to push the cage against the wall of the box along which it slides and towards the clamping element of the strip whenever the distance between the clamping elements of the strip and of the cage is different from the maximum separation distance therebetween.

* * * * *